US005577908A

United States Patent [19]

Glascock

[11] Patent Number: 5,577,908

[45] Date of Patent: Nov. 26, 1996

[54] APPARATUS FOR PROCESS FOR CONTINUOUS CURING

[75] Inventor: Battle Glascock, Signal Mountain, Tenn.

[73] Assignee: General Thermal, Inc., Chattanooga, Tenn.

[21] Appl. No.: 426,863

[22] Filed: Apr. 24, 1995

[51] Int. Cl.[6] ..... F27D 3/00

[52] U.S. Cl. ..... 432/239; 432/14; 432/120; 432/159; 432/200; 432/246

[58] Field of Search ..... 432/14, 120, 121, 432/159, 200, 239, 246

[56] References Cited

U.S. PATENT DOCUMENTS

| | | |
|---|---|---|
| 2,481,218 | 9/1949 | Hindall . |
| 4,160,309 | 7/1979 | Scholle . |
| 4,331,516 | 5/1982 | Meighan . |
| 4,338,163 | 7/1982 | Rittenhouse . |
| 4,656,706 | 4/1987 | Mahato et al. . |
| 4,713,304 | 12/1987 | Rao et al. . |
| 4,878,521 | 11/1989 | Frederickson . |
| 4,909,955 | 3/1990 | Morris et al. . |
| 5,252,105 | 10/1993 | Witherspoon et al. . |

OTHER PUBLICATIONS

Chapter entitled "Curing of Freshly Pasted Plates (Hydroset)", 3 pages Source and author unknown.

Article entitled "The Curing–or Killing–of Lead–Acid Positives", 2 pages Authors: L. T. Lam and D. A. J. Rand, Australia Source unknown.

*Primary Examiner*—Henry A. Bennett
*Assistant Examiner*—Siddharth Ohri
*Attorney, Agent, or Firm*—Dowell & Dowell

[57] ABSTRACT

An apparatus and method suitable for the continuous curing of pasted battery plates. The apparatus includes a hydroset oven having an atmospherically controlled hydroset chamber in which a continuous transport conveyor is mounted. Pasted plates are automatically loaded onto the transport conveyor and moved continuously through the hydroset chamber. Plenums are positioned in the hydroset oven chamber adjacent to the transport conveyor to direct temperature and humidity controlled air over the battery plates to affect hydrosetting. Additional hydroset ovens may be provided depending on the quantity of battery plates being processed. The apparatus also includes a drying oven containing a continuous transport conveyor. The drying oven is arranged in series with the hydroset oven to receive the hydroset battery plates and dry them in a continuous process.

29 Claims, 8 Drawing Sheets

2/8

208
204
196
70
170b
66
98
92
94
112
22
42
44
202
124
B
96
34d
200
5
144
164
78
170a
66
68a
98
68
40
90
22
138
34c
126
22
34b
38
44
112
126
34a
5
138
148
36
50
110
34
24
22
32
22
20

138
58
148
64
144
A
6
60
78
B
72
62
80
70
176a
98
176b
66
98
68a
36
54
68d
180a
56
98
C
68c
68
180b
68b
182b
92
170a
46
182a
170b
110
112
94
34
22
82
96
90
84
22
86
34a
44
174a
174b
88
34b
44
6
48

194
195
60
166
74
70
D
70
76
72
192a
173
B
77
168
190a
188a
192a
170a
68c
76
186a
52
50
96
86
88
68d
84
34
48

Fig. 8
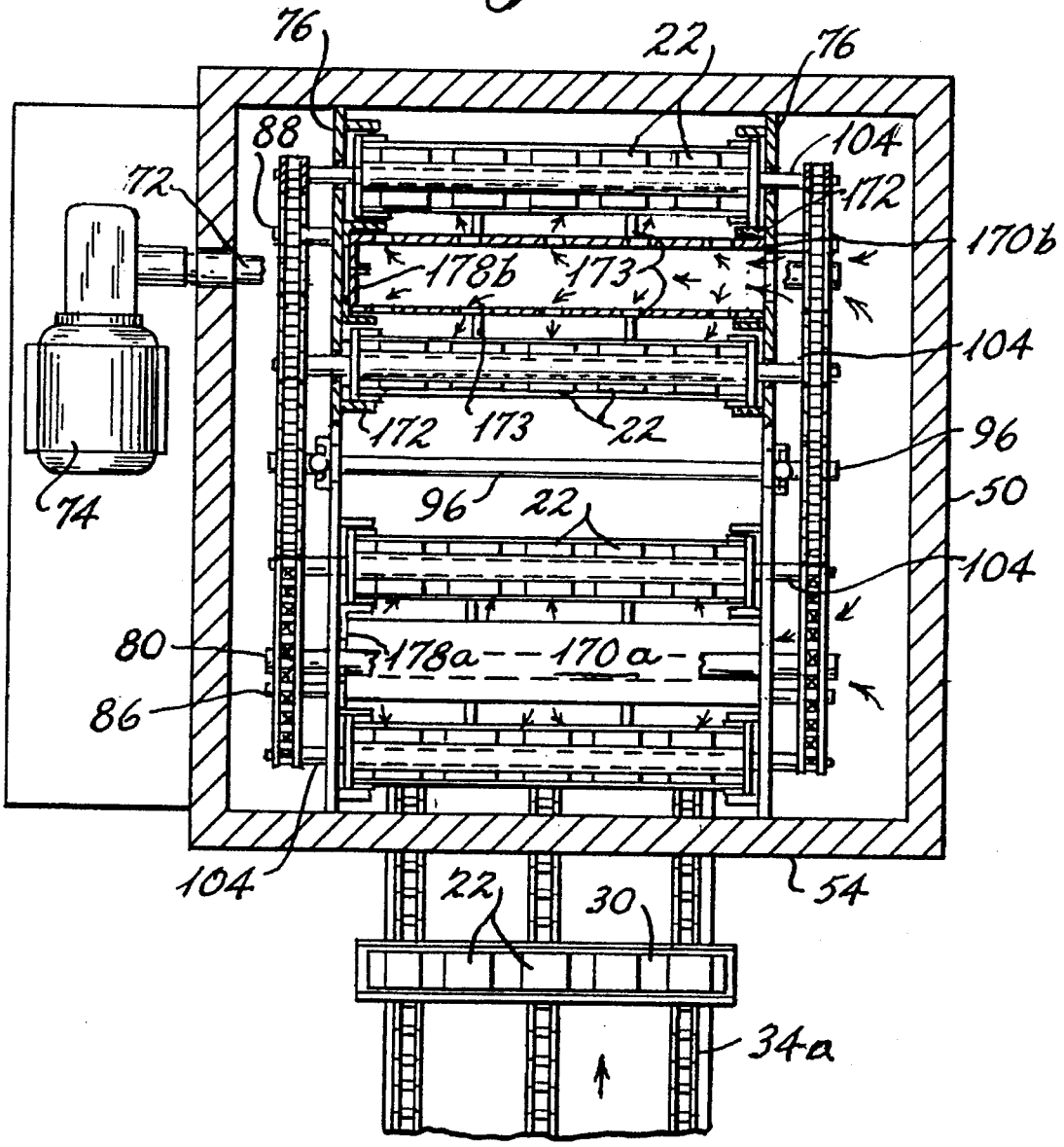
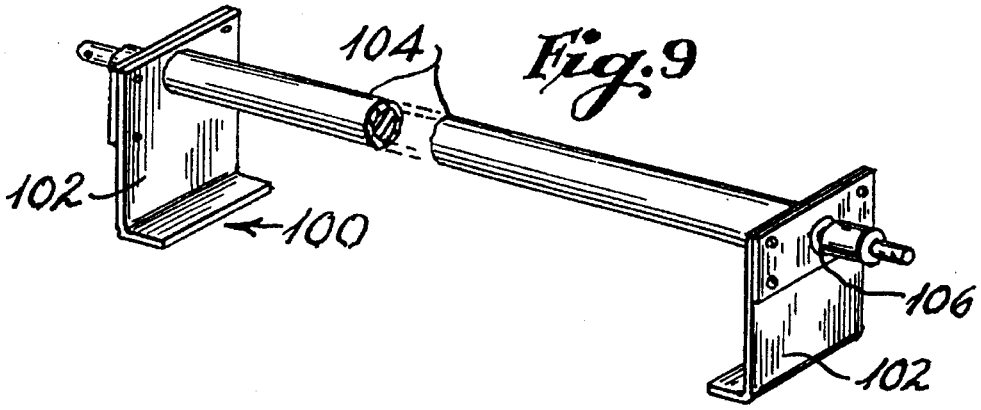
Fig. 9

APPARATUS FOR PROCESS FOR CONTINUOUS CURING

BACKGROUND OF THE INVENTION

1. Field of the Invention

The invention relates to the field of battery production and, more particularly, to an apparatus and method suitable for the continuous hydrosetting, drying and cooling of battery plates.

2. Background of the Related Art

The known methods of manufacturing battery plates for vehicle and industrial lead acid batteries involve the assembly of the individual battery components. The first step of manufacture is to mold a lead or lead alloy wire screen or matrix, by casting molten lead onto a grid structure. Next, a paste composed of lead oxide (i.e., free lead particles and alpha and beta forms of lead monoxide), dilute sulfuric acid and water, is pressed into the open areas of the grid. The components of the paste are blended together in proportions specified by the battery manufacturer. The pasted plates are delivered to a high-temperature flash drying oven to reduce the water content of the paste to an optimum range for subsequent processing, and to dry the outer surface of the lead paste sufficiently so that the plates can be handled in subsequent processing without the plates sticking together.

After the battery plates have been removed from the flash drying oven, they are typically manually loaded onto racks or pallets and temporarily stacked for subsequent loading into a batch-type oven. The chambers of the batch-type ovens used in the production of battery plates are commonly known as hydroset chambers. Hydroset chambers provide the necessary conditions to cure the lead oxides contained within the lead paste so as to form a crystalline structure, which is porous and provides good adhesion to the lead support. Curing also converts any free lead particles in the paste to different chemistries.

The curing process within the hydroset chamber includes three distinct stages. The first stage is the steaming, or so-called hydroset stage, which establishes the correct atmosphere for the development of basic lead sulfates within the paste, and equalizes the moisture content between the stacks of plates.

The second stage is a relatively lower level humidity treatment, which promotes the oxidation of the free lead in the paste and the conversion to monobasic, tribasic and tetrabasic lead compounds.

The third stage of curing comprises drying the hydroset plates to reduce the water content of the past to an extremely low level, which closely approaches zero. Such a low moisture level is required for active material stability.

There are two known processes widely used in the steaming or hydroset stage of battery production; namely, a manual process and the above-described process utilizing batch-type ovens. In the manual method, the pasted battery plates are placed on a pallet and covered with a wet piece of material such as burlap or canvas. The pallet is then placed in an enclosed heated area for a minimum of three days, until the hydrosetting has been completed.

The manual method has several limiting disadvantages. It requires a vast amount of floor space for storing the pallets during hydrosetting. Also, an extended period of time is required for the hydroset process to be completed. Furthermore, the manufacturer does not have close control of the progress and degree of completion of hydrosetting, and thus it is difficult to determine whether the process has been completed at a given time. Consequently, a large amount of time is wasted by allowing hydrosetting to continue longer than necessary due to the difficulty of knowing whether the hydroset process has been completed.

The hydrosetting process utilizing batch-type ovens is presently the most commonly used process because it reduces the hydroset process time to approximately forty-five hours, as compared to at least seventy-two hours for the manual hydroset process.

Most of the batch-type hydroset ovens in use today have indirect fired natural gas, steam, or electrical heating systems and water injection systems to provide the desired temperature and humidity conditions within the hydroset chamber. Microprocessor control is conventionally used to enable temperature and humidity ramping during each stage of the curing process. The batch-type oven chambers typically include a stainless steel interior to resist the adverse effects of high humidity and temperature, and an opening for loading and unloading the palletized battery plates.

The known battery manufacturing systems incorporate automated equipment in the grid casting, plate pasting, plate wrapping and formation stages. The systems do not, however, include an automated and modernized hydroset stage.

The hydroset stage of battery manufacturing in the known systems is linked closely to the battery plate flash drying systems which partially dry the pasted plates to enable the plates to be handled prior to the hydroset stage. The flash-drying and hydrosetting stages, however, consume a large amount of energy and represent a significant portion of the cost of battery plate manufacturing. In addition, the known batch-type hydroset equipment occupies a large amount of floor space and, accordingly, necessitates the use of larger, more expensive manufacturing facilities.

The known systems also require the palletizing or batching of battery plates, which is labor intensive and requires equipment for the handling of extremely heavy pallets of lead pasted plates.

Furthermore, the known hydrosetting processes are unable to achieve consistent, uniform hydrosetting of each individual battery plate. Consequently, the known processes are unable to ensure that high quality standards are consistently achieved. The known methods are limited due to the wide variability in the conditions the individual battery plates within the hydrosetting chamber are subjected to. The local conditions within the chamber are affected by factors such as the pallet stacking configuration, pallet location within the chamber relative to the locations of the air supply and return outlets, the total batch size in a particular run of battery plates, and the order of loading of a particular pallet of plates; in batch processing, the first pallet placed in the chamber is removed last. Any of these factors can cause the individual plates to be subjected to different curing conditions and, consequently, to form different free lead and moisture percentages. As a result, present battery plate production is inconsistent and the battery plates are frequently of poor quality.

SUMMARY OF THE INVENTION

The present invention has been made in view of the above-described disadvantages associated with the known apparatuses and processes used for the curing of battery plates and has as an object to provide an apparatus and a process suitable for the continuous and uniform curing of battery plates, as well as other materials treated by curing.

It is another object of the invention to provide an automated, continuous hydroset and curing process capable of treating as-pasted battery plates not having been subjected to flash drying.

It is a further object of the invention to provide a process which achieves uniform hydrosetting of large numbers of battery plates and consistent, high manufacturing quality standards.

It is yet another object of the invention to provide a process which eliminates batch processing and the associated manual handling of the battery plates, and requires a reduced amount of floor space to perform the hydrosetting process.

To achieve the objects of the invention, as embodied and broadly described herein, the apparatus in accordance with a preferred embodiment of the invention comprises a hydroset oven including a hydroset chamber and a charging means for automatically introducing a material into the hydroset chamber. A transport means is mounted within the hydroset chamber to transport the material therethrough along a continuous path comprising at least one substantially vertical upward run and at least one substantially vertical downward run. An air supply means is provided for supplying into the hydroset chamber treated air of an effective temperature and humidity to affect hydrosetting of the material. An air directing means is mounted within the hydroset chamber to direct treated air over material as it is being transported through the hydroset chamber. A discharge means is provided for discharging the material from the hydroset oven.

The apparatus also comprises a drying oven including a drying chamber, and a charging means for automatically introducing material discharged from the hydroset oven into the drying chamber. A transport means is mounted within the drying chamber to transport the material therethrough along a continuous path comprising at least one substantially vertical upward run and at least one substantially vertical downward run. An air supply means is provided to supply into the drying oven heated air of an effective temperature and humidity to dry the material. The heated air is directed over material being transported through the drying chamber to affect drying.

A method of treating material which utilizes the apparatus in accordance with the invention is also disclosed.

BRIEF DESCRIPTION OF THE DRAWINGS

In the accompanying drawings:

FIG. 8 is a cross-sectional top plan view of the hydroset oven in the direction of line 8—8 of FIG. 4;

FIG. 9 is a perspective view of a transfer tray carrier in accordance with a preferred embodiment of the invention.

DETAILED DESCRIPTION OF THE PREFERRED EMBODIMENTS

Figure 1:
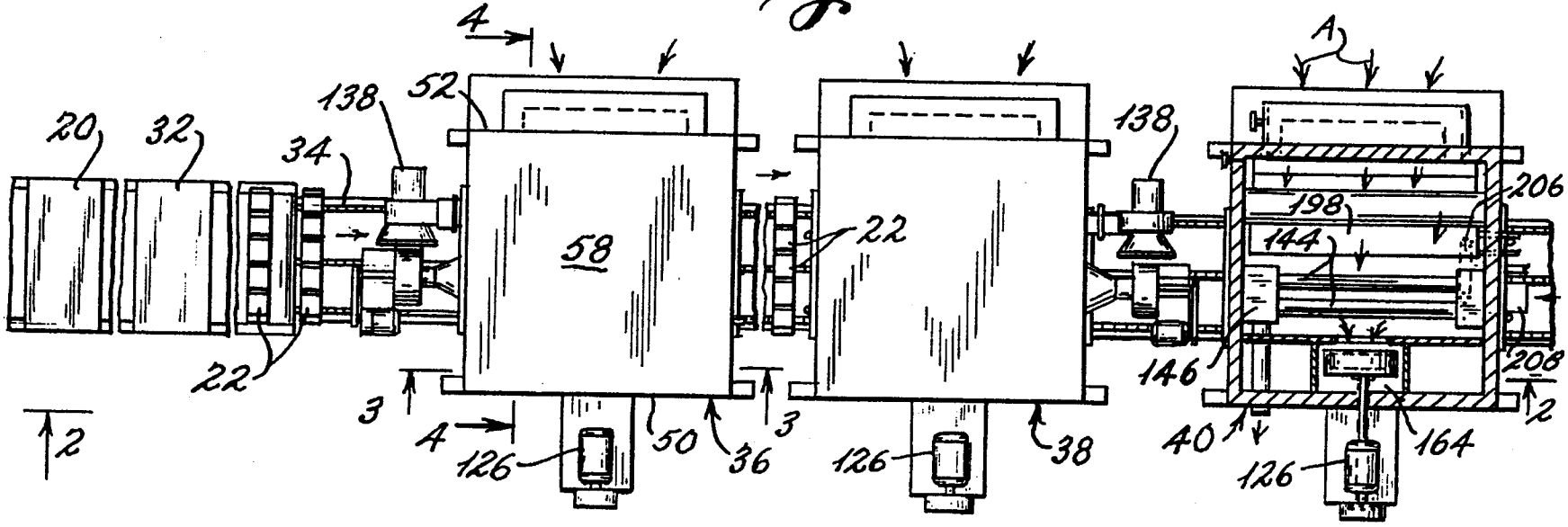
FIG. 1 is a top plan illustrational view of a section of a battery plate manufacturing line which comprises a hydroset oven, a drying oven, and a cooling station shown partially in cross-section, in accordance with a preferred embodiment of the invention.

The invention will now be described in detail in conjunction with the drawing figures. In the drawings, common reference numbers are used to identify common elements illustrated in the figures.

Figure 2:
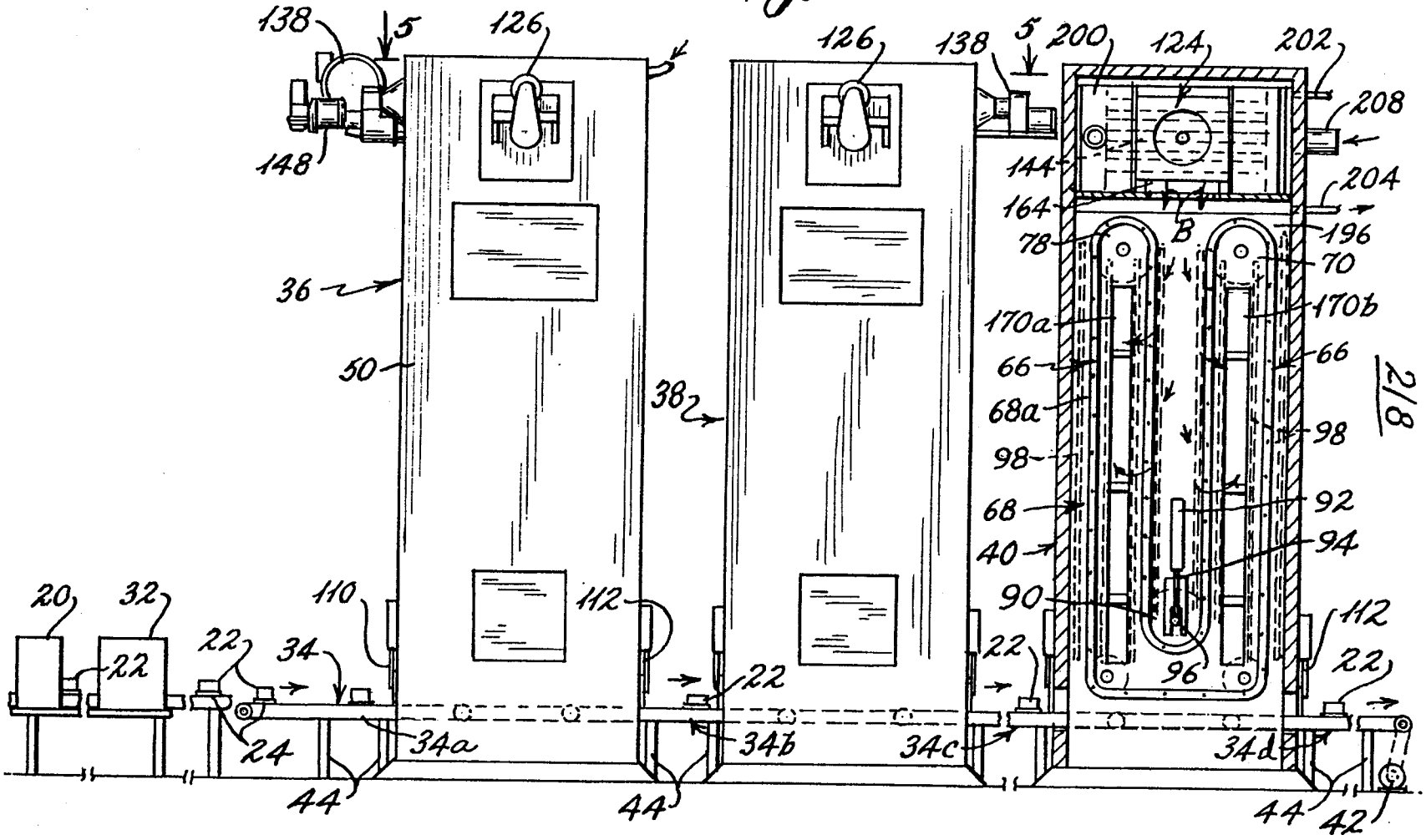
FIG. 2 is a front elevational view in the direction of line 2—2 of FIG. 1 illustrating the interior structure of the cooling station.

FIGS. 1 and 2 illustrate a portion of an automated manufacturing system for the pasting and curing of battery plates used in batteries for vehicles and industrial uses. The system comprises a conventional pasting machine 20 which applies lead oxide paste to battery plate grids. The pasted plates 22 are arranged in five stacks on transfer trays 24. The stacks typically contain approximately fifty plates each. Depending on the size and weight of the plates and the size of the transfer trays, different numbers of stacks and stack sizes may used.

Figure 10:
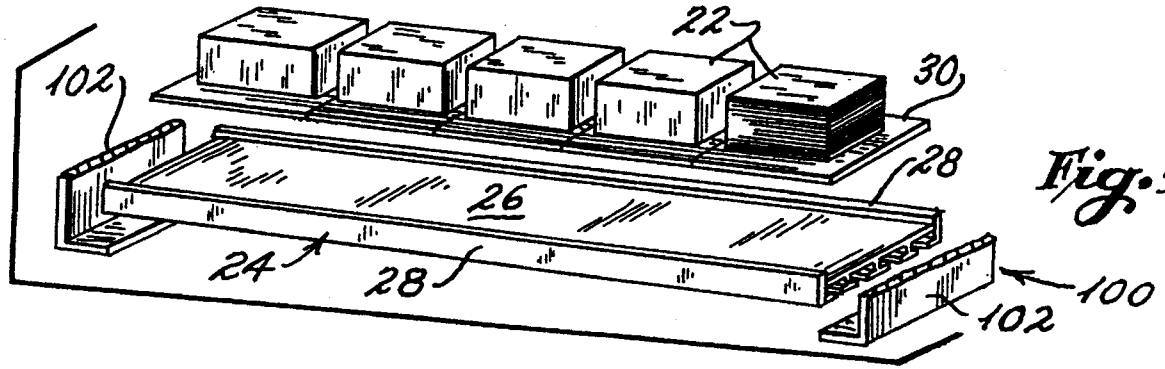
FIG. 10 is an exploded view illustrating the manner of loading of stacks of battery plates onto a transfer tray and placing the transfer tray onto a transfer tray carrier as shown in FIG. 9.

As shown in FIG. 10, the transfer trays 24 include an upper surface 26 and opposed vertical side walls 28 which extend above the upper surface. The plates 22 are preferably positioned on a plate 30, which in turn is placed on the upper surface of the transfer tray. The side walls 28 extend above the plate 30 and maintain the battery plates on the transfer trays.

The pasted battery plates 22 are transferred to a flash drying oven 32 downstream of the pasting machine 20, and passed rapidly through the flash drying oven to dry the outer surface of the paste. After being flash dried, the plates 22 are transferred to a charging section **34*a* of a horizontal conveyor 34 located at the charging end of a hydroset oven 36** in accordance with a preferred embodiment of the invention.

In accordance with the invention, the pasted plates may optionally be introduced directly into the hydroset oven 36 from the pasting machine 20 without being flash dried. By eliminating the flash drying step, energy expenses are significantly reduced.

The hydroset oven 36 is shown arranged in series with a drying oven 38 constructed in accordance with a preferred embodiment of the invention. An intermediate section **34*b* of the conveyor 34 extends between the hydroset oven and the drying oven to transport the hydroset plates therebetween. Depending on the number of battery plates being cured, additional hydroset ovens and/or drying ovens may be added in series with the single hydroset oven 36 and drying oven 38**. For example, two to four hydroset ovens may be required to meet the production demands of an average facility.

A cooling station 40 in accordance with a preferred embodiment of the invention is shown positioned downstream from the drying oven 38 to affect rapid cooling of the dried battery plates. An intermediate section **34*c* of the conveyor 34 carries the dried plates to the cooling station. A discharge section 34*d* of the conveyor is located at the discharge end of the cooling station. The conveyor is driven by a motor 42 located adjacent to the discharge end of the cooling station. The conveyor is supported by vertically adjustable supports 44** provided along its length.

Figure 3:
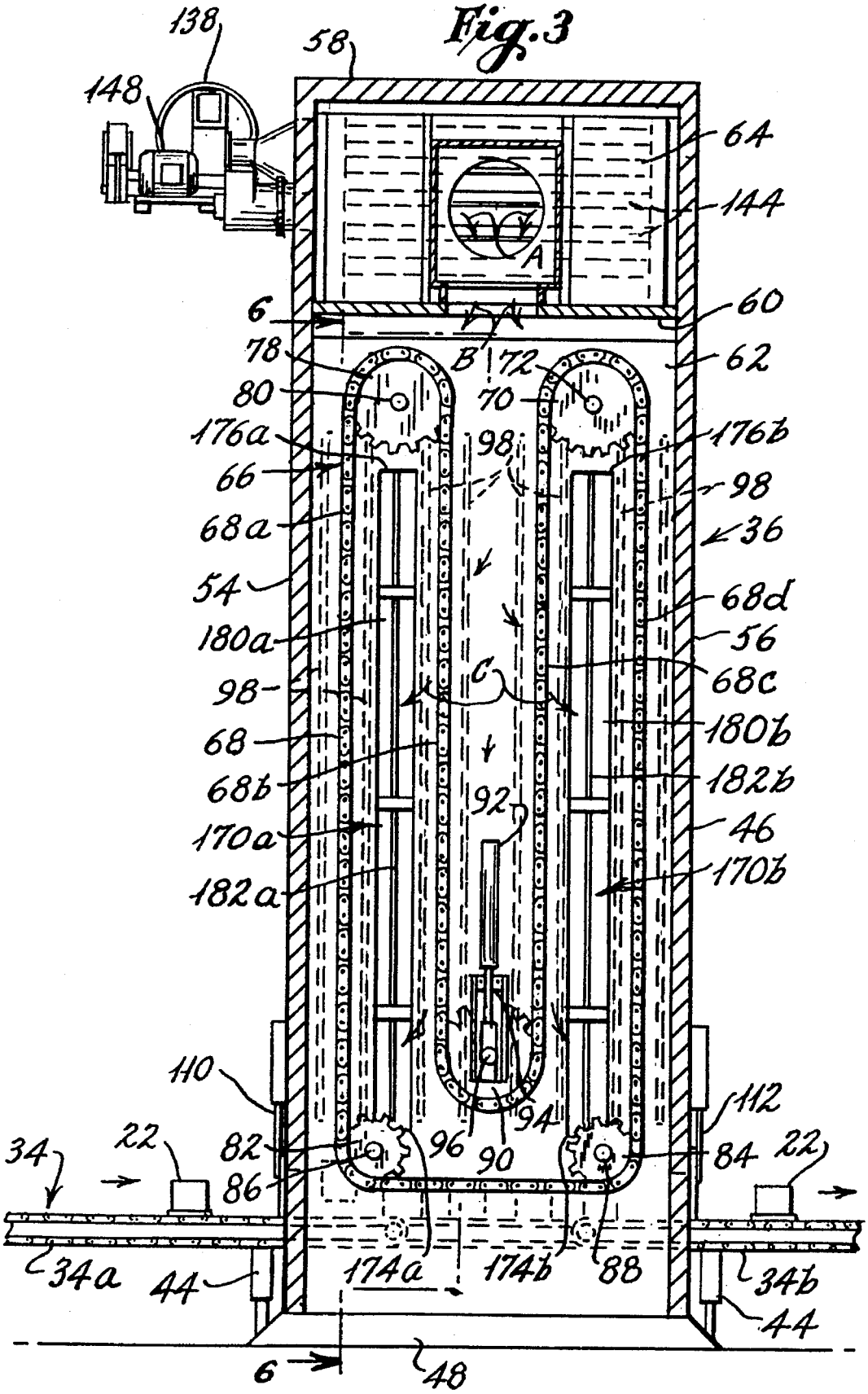
FIG. 3 is a cross-sectional front elevational view in the direction of line 3—3 of FIG. 1 illustrating the interior structure of the hydroset oven.

Referring to FIG. 3, the hydroset oven 36 comprises an outer housing 46, preferably formed of a corrosion resistant material such as stainless steel. The outer housing is preferably thermally insulated to maintain a constant temperature within the hydroset oven and reduce energy consumption.

The outer housing 46 rests on a base 48 and comprises a front wall 50, a rear wall 52 (FIG. 1), side walls 54, 56 and a top wall 58. A horizontal dividing wall 60 divides the hydroset oven into two chambers; a lower chamber 62 referred to herein as the hydroset chamber, in which battery plates are hydroset, and an upper chamber 64 referred to herein as the air supply chamber, in which air is treated before being introduced into the hydroset chamber 62.

A continuous lifting and lowering conveyor system 66 is mounted within the hydroset chamber 62 to transport the pasted battery plates at a controlled speed. The conveyor system comprises a continuous conveyor roller chain 68 which includes four substantially vertical runs 68*a*, 68*b*, 68*c* and 68*d*. The runs 68*a* and 68*c* are upward runs, and the runs 68*b* and 68*d* are downward runs. Different numbers of runs may be provided depending, for example, on the size of the hydroset chamber.

Figure 6:
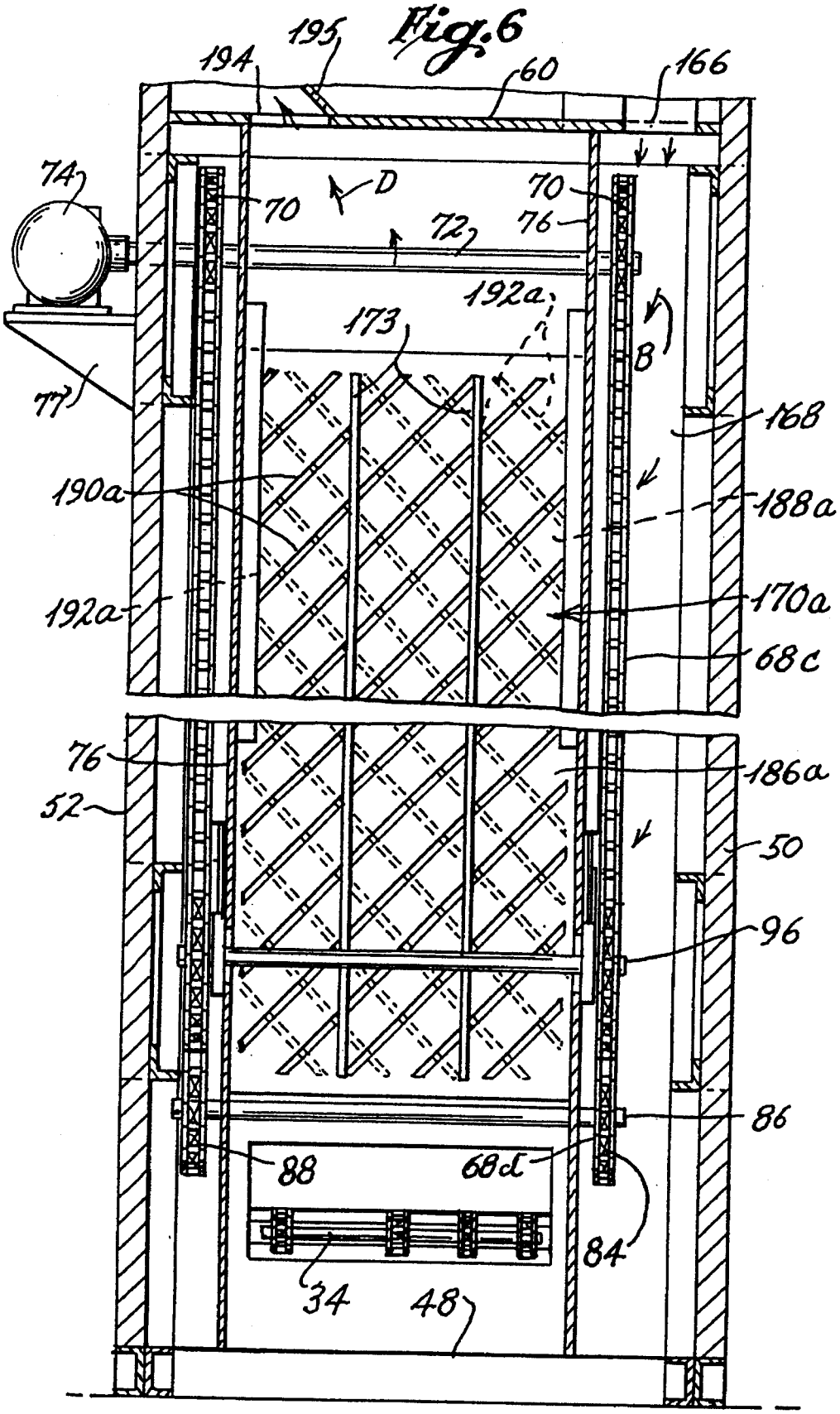
FIG. 6 is a cross-sectional side elevational view of a portion of the hydroset oven in the direction of line 6—6 of FIG. 3.

The roller chain 68 rides over a plurality of pairs of sprockets and is driven by drive sprockets 70 mounted on a drive shaft 72. Referring to FIG. 6, the drive shaft 72 is mounted to a pair of vertical walls 76 extending between the base 48 to the dividing wall 60. The drive shaft 72 is driven by a motor 74 mounted on a motor support platform 77 secured to the rear wall 52 of the outer housing.

As shown in FIG. 3, a large diameter idler sprocket 78 is mounted on a shaft 80, and smaller diameter idler sprockets 82, 84 are mounted on shafts 86, 88, respectively. (The other sprocket of each pair is not shown in this figure.) Referring to FIG. 8, the shafts 72, 80, 86 and 88 are mounted to the vertical walls 76 at opposite ends of the shafts.

Figure 7:
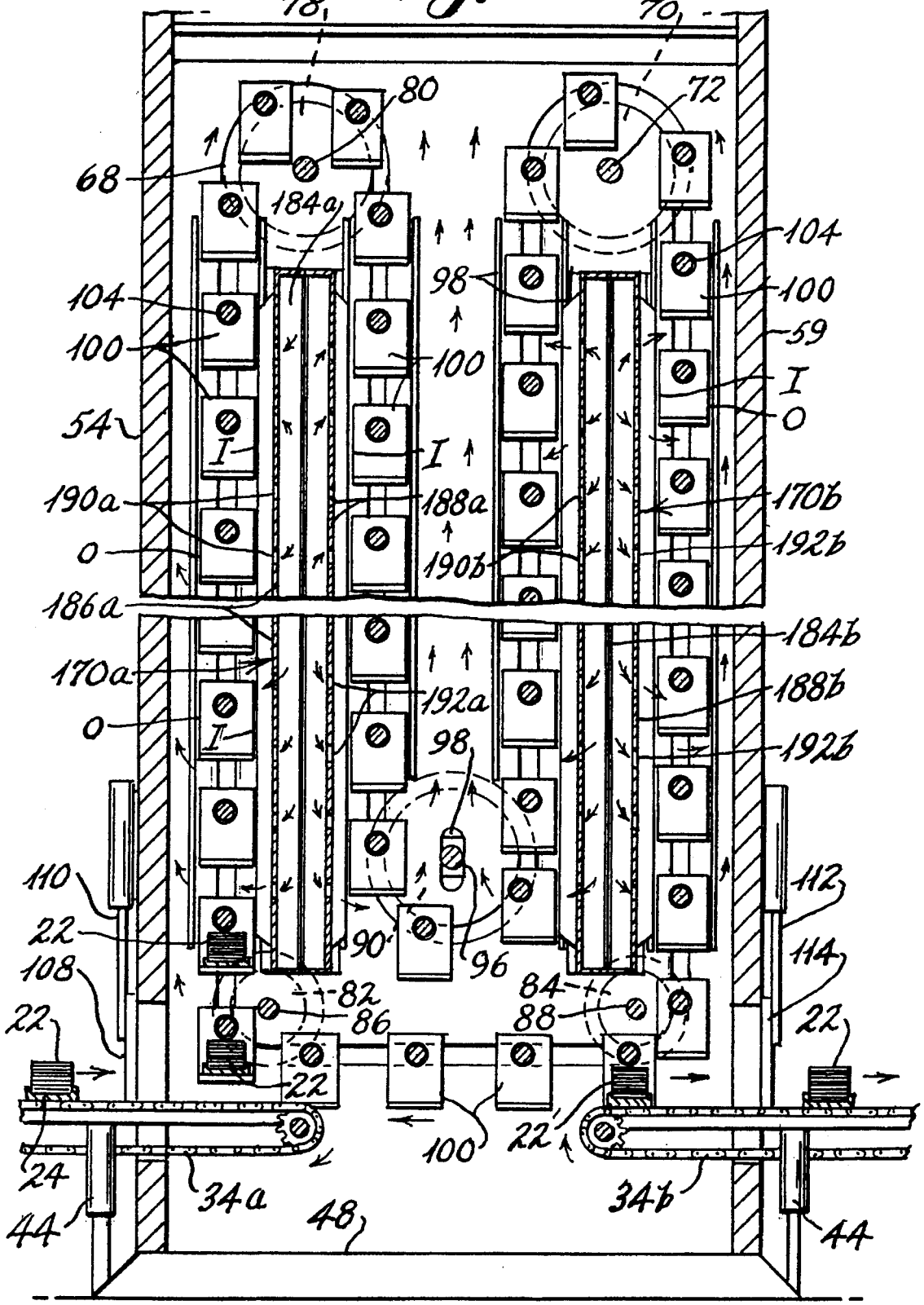
FIG. 7 is a cross-sectional front elevational view of the hydroset oven in the direction of line 7—7 of FIG. 4.

As shown in FIG. 3, an intermediate sprocket 90 is connected to a roller chain tension adjuster 92. The tension adjuster comprises a piston 94 connected to the shaft 96 of the sprocket 90. As shown in FIG. 7, the shaft 96 moves relative to the sprocket 90 within a vertical slot 98 formed in sprocket. The piston controls the tension on the roller chain 68 to compensate for fluctuations during normal operation.

Figure 4:
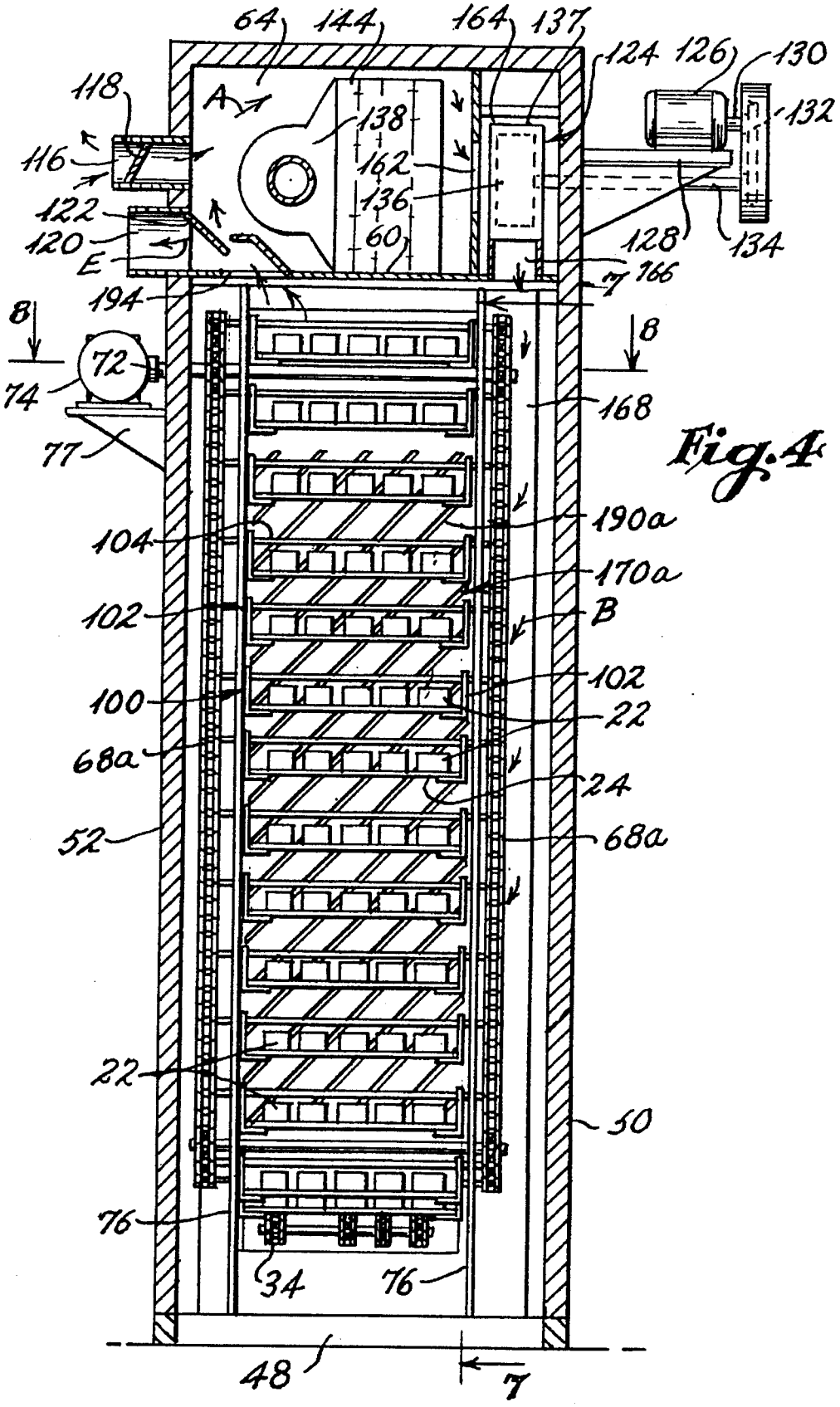
FIG. 4 is a cross-sectional side elevational view of the hydroset oven in the direction of line 4—4 of FIG. 1.

As shown in FIGS. 3 and 4, vertical chain guides 98 are preferably positioned adjacent to both sides of each vertical run of the roller chain 68 to limit its sideways movement.

As depicted in FIGS. 9 and 10, battery plate carriers 100 are provided to carry the transfer trays 24 and battery plates 22 through the hydroset chamber 62 (see FIG. 3). The battery plate carriers are comprised of a pair of L-shaped brackets 102 mounted on a shaft 104. Bearings 106 enable the brackets 102 to rotate about the shaft 104 as the battery plates are carried through the hydroset oven, to maintain the battery plates in a substantially horizontal orientation.

FIG. 7 depicts a plurality of the battery plate carriers 100 fastened to the roller chain 68 at spaced locations. The battery plates 22 arranged in stacks on the transfer trays 24 are introduced into the hydroset chamber 62 through a charging opening 108. A sliding closure 110 is provided to open and close the charging opening. The closure 110 is illustrated in the open position, in which the battery plates may be introduced into the hydroset chamber. The battery plate carriers 100 include L-shaped brackets 102 which ride under and engage the transfer trays 24 to automatically load the transfer trays off the section 34*a* of the conveyor. This is best visualized by referring to FIG. 10.

After being transported through the hydroset oven 36, the hydroset battery plates 22 are automatically unloaded by the carriers 100 onto the section 34*b* of the conveyor located at the discharge end of the hydroset oven. Battery plates 22' are shown being unloaded. A sliding closure 112 is shown in the open position, in which the battery plates can be transported out of the hydroset oven through a discharge opening 114 in the hydroset oven.

The battery plate carriers 100 are preferably fastened to the roller chain 68 at locations such that a load of flashdried battery plates is engaged by a carrier and loaded onto the roller chain off the conveyor 34 at approximately the same time a load of battery plates is being unloaded onto the conveyor at the discharge end of the hydroset oven. The opening and closing of the sliding closures 110, 112 is also preferably coordinated with loading and unloading of the battery plates.

The hydroset oven 36 comprises an air supply system for introducing air of a controlled temperature and humidity into the lower hydroset chamber 62 to affect hydrosetting of pasted battery plates being transported by the conveyor system 66. Referring to FIG. 4, a fresh air inlet 116 is provided at the rear wall 52 of the outer housing. A fresh air damper 118 is mounted within the fresh air inlet to control air flow into and out of the air supply chamber 64 as indicated by the arrows A.

An exhaust outlet 120 is provided below the fresh air inlet 116. An exhaust damper 122 is located within the exhaust outlet to control exhaust air flow as described hereinbelow.

Fresh air is drawn into the air supply chamber 64 through the inlet 116 by an air circulation fan 124. The fan comprises a motor 126 mounted on a base 128 connected to the front wall 50 of the outer housing 46. The drive shaft 130 of the motor is connected via a belt 132 to a shaft 134. A centrifugal blower 136 is mounted on the shaft 134 and enclosed by a cover 137.

Figure 5:
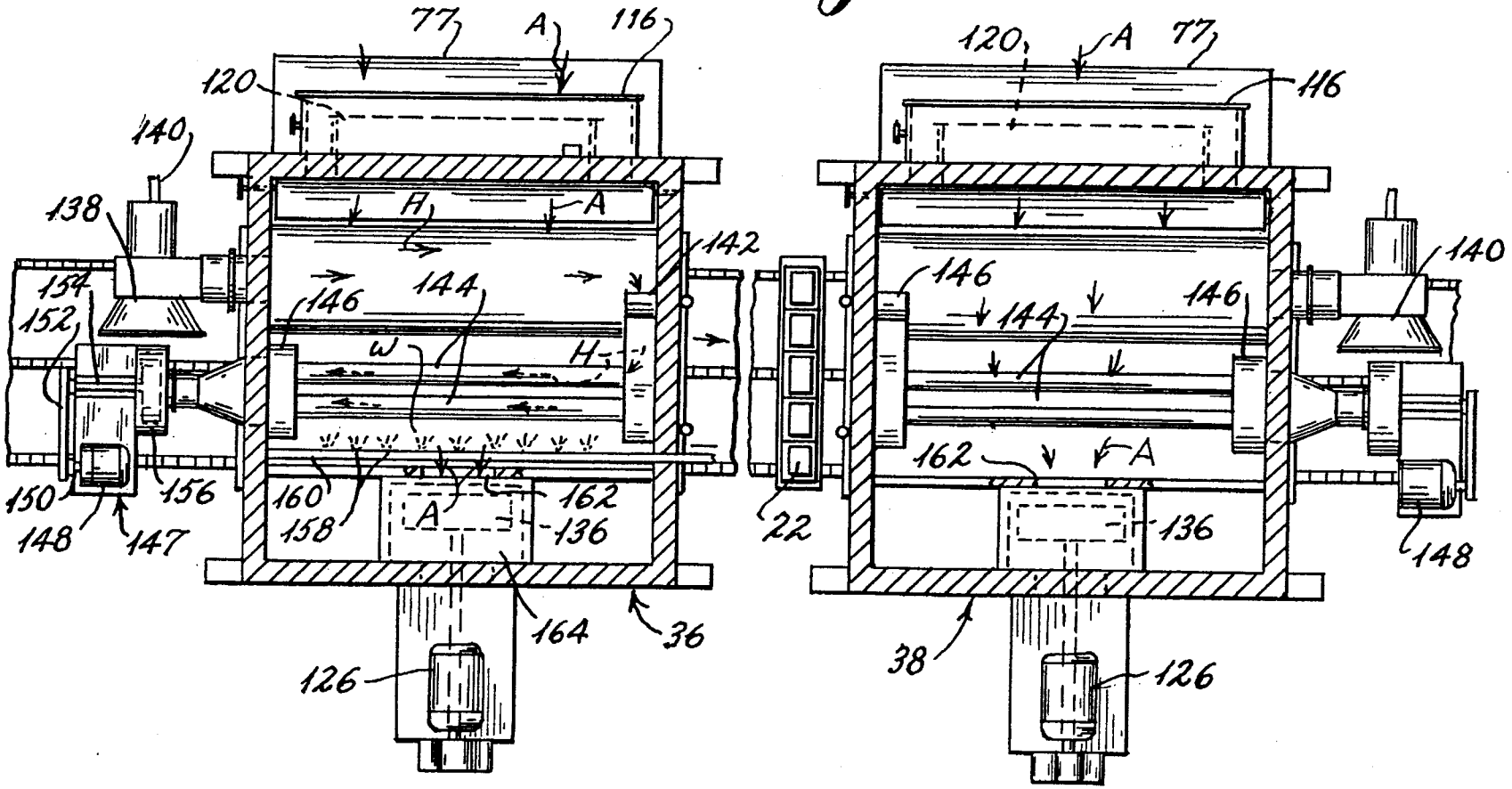
FIG. 5 is a cross-sectional top view of the hydroset oven and the drying oven in the direction of line 5—5 of FIG. 2.

The air drawn into the air supply chamber 64 is heated before being introduced into the hydroset chamber 62. An indirect gas-fired air heating system is preferably provided for this purpose. Referring to FIGS. 3 and 5, a burner 138 is mounted to the sidewall 54 of the outer housing. The burner is preferably fueled by natural gas supplied by a fuel line 140. The air H heated by the burner is directed to a header 142, which directs the heated air through a plurality of heat exchange tubes 144 of a heat exchanger 146 to heat the tubes.

A heat exchange exhaust system is mounted exterior to the sidewall 54. The exhaust system comprises a fan 147 including an exhaust motor 148 having a drive shaft 150. A belt 152 connects the drive shaft to a shaft 154 on which a centrifugal blower 156 is mounted. The fan 147 draws the heated air H through the heat exchange tubes 144 and exhausts the heated air exteriorly of the upper chamber 64.

As illustrated in FIG. 4, ambient air A drawn into the air supply chamber 64 by the fan 124 flows over the heat exchange tubes 144 and is heated to a desired temperature.

Referring to FIG. 5, the humidity of the heated air is increased by spraying water onto the heat exchange tubes 144 to form water vapor which mixes with the heated air. The water W is preferably sprayed onto the tubes by a plurality of spaced nozzles 158 provided in a water supply line 160.

Referring to FIG. 4, the humidified air is drawn into an inlet opening 162 of a fan chamber 164. The fan 124 directs the air downward through a passage 166 as indicated by arrows B and into a front channel 168 of the hydroset chamber 62 adjacent the front wall 50 of the outer housing.

The air introduced into the hydroset chamber 62 preferably is at a temperature of from about 120° F. to about 170° F., and a humidity level of about 100%.

As shown in FIG. 5, an air heating system is also provided in the drying oven 38. The air heating system in the drying oven is preferably of the same construction as the air heating system in the hydroset oven. The heated air introduced into the drying chamber (not shown) is preferably at a temperature of from about 180° F. to about 200° F. to affect a proper rate of drying of the hydroset battery plates to avoid cracking and spalling.

The drying oven 38 is not provided with a water spraying system as the heated air introduced into the drying chamber is of a relatively low humidity to promote drying of the battery plates. Accordingly, as corrosion due to high humidity is not a major concern with respect to the drying oven, the outer housing of the drying oven may be formed of mild steel and the like, which is preferably thermally insulated.

As illustrated in FIGS. 3 and 4, the heated and humidified air B introduced into the front channel 168 of the hydroset chamber 62, is directed toward a pair of horizontally spaced plenums 170*a*, 170*b*, each of which is positioned between a pair of vertical runs of the roller chain 68.

Referring to FIG. 8, the plenums 170*a*, 170*b* are mounted to the vertical walls 76 at opposed ends by brackets 172. Spacers 173 maintain the roller chain a distance from the plenums. The plenums are closed at the bottom wall 174*a*, 174*b*, the top wall 176*a*, 176*b* and the rear wall 178*a*, 178*b*. Referring to FIG. 3, the front walls 180*a*, 180*b* of the plenums define a respective vertical slot 182*a*, 182*b* extending from the bottom wall to the top wall. The air introduced into the front channel 168 passes through the vertical slots as indicated by the arrows C and enters an interior plenum chamber 184*a*, 184*b* of the respective plenums 170*a*, 170*b* (FIG. 7).

The air is discharged from the plenums 170*a*, 170*b* through a plurality of air discharge slots formed in the plenum side walls. Referring to FIG. 7, the plenum 170*a* includes side walls 186*a*, 188*a*, which define air discharge slots 190*a*, 192*a*, respectively. The plenum 170*b* includes side walls 186*b*, 188*b*, which define air discharge slots 190*b*, 192*b*, respectively. The discharged air represented by arrows D is directed against the inner side faces I of the battery plates 22 being transported by the roller chain. The outer side faces 0 of the battery plates are not directly treated by the discharged air.

Referring to FIG. 6, the air discharge slots 190*a* in the side wall 186*a* of the plenum 170*a* are parallel to each other and oriented at an acute angle, preferably of about 45°, relative to the horizontal. The slots 190*a* are approximately perpendicular to the air discharge slots 192*a* depicted in dotted line in the opposed side wall 188*a* of the duct 170*a*. The same relative orientation of the air discharge slots is also provided in the opposite duct 170*b* (not shown). Accordingly, the air discharge slots 190*a*, 190*b* adjacent to the upward runs 68*a*, 68*c* of the roller chain are parallel with respect to each other, and the air discharge slots 192*a*, 192*b* adjacent to the downward runs 68*b*, 68*d* are parallel to each other.

Referring to FIGS. 4 and 7, as the battery plates 22 are transported upward along the upward run 68*a* of the roller chain, air is discharged from the slots 190*a* and directed against the inner side faces I of the battery plates at about a 45° angle, in a direction from the top to the bottom of the stacks. At a given position along the run, air is directed against only a portion of the inner side face of each individual battery plate. As the plates continue to move upward along the run, the entire inner side face of each plate is treated by the discharged air.

Along the run 68*b* of the roller chain, the battery plates are moved downward past the air discharge slots 192*a*, such that the inner sides I of the stacks of battery plates are treated by the discharged air. The inner sides I along run 68*b*, however, are the outer sides 0 along the previous run 68*a*. Consequently, both sides of the battery plates are treated by the discharged air along the pair of runs 68*a*, 68*b* of the roller chain 68.

The battery plates are treated in the same manner by air discharged from plenum 170*b* during transport along the pair of runs 68*c*, 68*d*.

In those instances when a single hydroset oven is used, the battery plates are transported along the continuous conveyor at an effective speed along the runs of the roller chain such that the battery plates are fully hydroset before reaching the discharge end of the hydroset oven. The battery plates are preferably continuously transported by the continuous conveyor. The continuous conveyor may optionally be stopped for short periods of time to allow additional air treatment of the battery plates. Preferably, a full hydroset is achieved at a position close to the discharge end to maximize efficiency. As described above, more than one hydroset oven may optionally be provided in series to increase the production capacity of the present invention. In such instances, the battery plates are transported at an effective speed such that the battery plates are fully hydroset before reaching the discharge end of the final hydroset oven in the series.

The pattern of air flow through the air discharge slots and directed across the stacks of battery plates creates a pressure differential at the inner side faces I of the battery plates along each run of the roller chain, which draws moisture toward the top face of the plates and enhances internal drying of the plates. In addition, as the battery plates are moved vertically along the runs of the roller chain, the plates are exposed to varying air pressure, which further enhances internal drying.

As shown in FIGS. 4 and 6, the air discharged through the air discharge slots travels upwardly into the air supply chamber 64 through an exhaust opening 194 formed in the dividing wall 60. In the partially closed position of the exhaust damper 122 illustrated in FIG. 4, a portion of the air stream is exhausted into the atmosphere via the exhaust outlet 120 as indicated by the arrow E, and another portion of the air is recirculated into the air supply chamber (and eventually into the hydroset chamber 62) as indicated by the arrow F. In the fully closed position of the exhaust damper 122 (not shown), the exhaust damper abuts the deflector 195 and all of the air is exhausted into the atmosphere. In the fully opened position of the exhaust damper (not shown), all of the air from the hydroset chamber is directed into the upper chamber 64 and recirculated into the hydroset chamber.

The fresh air damper 118 located in the inlet 116 is adjustable to permit a controlled flow of fresh air into the upper chamber 64, to adjust the humidity level of the air introduced into the hydroset chamber to control hydrosetting.

As described above, the drying oven 38 also comprises a continuous lifting and lowering conveyor as provided in the hydroset oven to transport the battery plates at a controlled speed, and an air supply system for introducing heated air into the drying chamber (not shown) to affect continuous and uniform drying of the battery plates.

The speed of transport of the as-hydroset battery plates through the drying oven and the cooling station, is selected based on the same considerations as in the hydroset oven.

Referring to FIGS. 1 and 2, the cooling station 40 also comprises a continuous lifting and lowering conveyor 66 as in the hydroset oven and drying oven which is disposed in the cooling chamber. The cooling station comprises a cooled air system for producing cooled air and introducing the cooled air into the cooling chamber 196 to affect a controlled and rapid cooling of the dried battery plates.

The cooling system comprises a cooling coil 198 and a heat exchanger 146 having heat exchange tubes 144 mounted within the upper chamber 200 of the cooling station 40. An upper conduit 202 supplies a coolant such as cold water into the cooling coil. The coolant flows through the cooling coil, and is then discharged from the cooling station via a lower conduit 204. The discharged coolant is preferably passed to an exteriorly located cooling unit (not shown) before being reintroduced into the cooling coil via the upper conduit.

Air represented by arrows A is drawn into the upper chamber 200 by the fan 124 and over the cooling coil 198 to cool the air to a desired temperature. This cooling drys the air by causing moisture in the air to condense on the cooling coil. The condensate is collected in a drain 206 located below the cooling coil.

Cooled air from a source exterior to the cooling station (now shown) is introduced into the heat exchange tubes 144 via an air supply conduit 208. As the air cooled by the cooling coil passes over the cooled heat exchange tubes, it is further cooled and dried. Condensate forms on the heat exchange tubes and is collected in the drain 206.

The cooled air is drawn into the fan chamber 164 and directed downward into the cooling chamber 196 as indicated by arrows B, and into the plenums 170*a*, 170*b* adjacent the roller chain 68. The cooled air is directed against the stacks of battery plates in the same manner as in the hydroset oven and drying oven (not shown) to affect uniform cooling of the plates.

After being transported along each run of the roller chain, the cooled battery plates are automatically unloaded onto the section 34*d* of the conveyor.

The above-described present invention has many advantages, including the capability to continuously cure battery plates faster and in a more uniform and controlled manner than is achieved by the known apparatuses. The present invention can fully hydroset battery plates within about twelve hours and dry the plates within about six hours. This total time of about eighteen hours represents a significant time savings as compared to the known processes which typically require as many as seventy-two hours to complete curing.

In addition, the present invention reduces the cost of the curing process. The present invention is capable of curing pasted plates which are not subjected to flash drying before being introduced into the hydroset oven. Accordingly, significant energy expenses can be saved. Moreover, the present hydroset oven, drying oven and cooling station are energy efficient, to further increase savings.

Furthermore, the curing process is fully automated and by replacing the known batch-type processing, the amount of floor space required to conduct the curing process is vastly reduced. Cost savings are also achieved by eliminating the manual handling of the plates required in batch-type processing.

Although the present apparatus and process are particularly advantageous for the hydrosetting and curing of battery plates, the present invention has utility in other related applications. For example, the present invention may be used to cure other types of metal paste, including lead paste not used in battery plates, and to treat other types of parts and materials requiring or benefitting from a continuous hydrosetting, drying and cooling process.

The foregoing description of the preferred embodiment of the invention has been presented to illustrate the principles of the invention and not to limit the invention to the particular embodiment illustrated. The scope of the invention is defined by the embodiments encompassed within the following claims and their equivalents.

What is claimed is:

1. A method of treating pasted battery plates, comprising the steps of:

introducing pasted battery plates into a hydroset oven having a hydroset chamber;

transporting the pasted battery plates through the hydroset chamber along a first continuous path comprising at least one substantially vertical upward run and at least one substantially vertical downward run;

supplying treated air of an effective temperature and humidity to hydroset the battery plates into the hydroset chamber;

directing the treated air over the pasted battery plates to affect hydrosetting; and discharging the hydroset battery plates from the hydroset oven.

2. The method of claim 1, wherein the treated air is of a humidity level of about 100% and a temperature of from about 120° F. to about 170° F.

3. The method of claim 1, wherein the pasted battery plates are transported generally continuously through the hydroset chamber.

4. The method of claim 1, wherein the pasted battery plates are arranged in at least one stack, with each stack having a pair of opposed side faces, and including directing treated air against one of the opposed side faces along said at least one substantially vertical upward run, and directing the treated air against the other opposed side face along said at least one substantially vertical downward run.

5. The method of claim 4, further comprising the steps of:

introducing the hydroset battery plates discharged from the hydroset oven into a drying oven having a drying chamber;

transporting the hydroset battery plates through the drying chamber along a second continuous path comprising at least one substantially vertical upward run and at least one substantially vertical downward run;

supplying heated air into the drying chamber;

directing the heated air over the hydroset battery plates to affect drying; and discharging the dried battery plates from the drying oven.

6. The method of claim 5, wherein the heated air is of a temperature of from about 180° F. to about 200° F.

7. The method of claim 5, wherein the hydroset battery plates are transported generally continuously through the drying chamber.

8. The method of claim 5, wherein said first and second continuous paths each include a plurality of pairs of alternating substantially vertical upward runs and substantially vertical downward runs.

9. The method of claim 5, wherein the hydroset battery plates are arranged in at least one stack, with each stack having a pair of opposed side faces, and including directing the heated air against one of the opposed side faces along said at least one substantially vertical upward run, and directing the heated air against the other opposed side face along said at least one substantially vertical downward run.

10. The method of claim 9, further comprising the steps of:

introducing the dried battery plates discharged from said drying oven into a cooling chamber;

transporting the dried battery plates through the cooling chamber along a third continuous path comprising at least one substantially vertical upward run and at least one substantially vertical downward run;

supplying cooled air into the cooling chamber;

directing the cooled air against the dried battery plates to affect cooling; and discharging the cooled battery plates from the cooling chamber.

11. A method of curing a material, comprising the steps of:

introducing a material into a first oven having a first chamber;

transporting the material through the first chamber along a first continuous path comprising at least one substantially vertical upward run and at least one substantially vertical downward run;

supplying air of a temperature and humidity effective to hydroset the material into the first chamber;

directing the treated air against the material to affect hydrosetting; and discharging the hydroset material from the first oven.

12. The method of claim 11, further comprising the steps of:

introducing the hydroset material discharged from the first oven into a second oven having a second chamber;

transporting the hydroset material through the second chamber along a second continuous path comprising at least one substantially vertical upward run and at least one substantially vertical downward run;

supplying heated air of an effective temperature to affect drying of the hydroset material into the second chamber;

directing the heated air over the hydroset material to affect drying; and discharging the dried material from the second oven.

13. The method of claim 12, wherein said first and second continuous paths each include a plurality of pairs of alternating substantially vertical upward runs and substantially vertical downward runs.

14. The method of claim 13, wherein the material has a pair of opposed side faces, and including directing the treated air and heated air, respectively, against one of the opposed side faces along each substantially vertical upward run, and directing the treated air and heated air, respectively, against the other of the opposed side faces along each substantially vertical downward run, in said first chamber and said second chamber, respectively.

15. An apparatus suitable for the hydrosetting of a material disposed on a substrate, comprising:

a first oven including a first chamber;

charge means for automatically introducing a substrate having a material disposed thereon into said first chamber;

means mounted within said first chamber for transporting the substrate therethrough along a first continuous path comprising at least one substantially vertical upward run and at least one substantially vertical downward run;

air supply means for supplying treated air of an effective temperature and humidity to affect hydrosetting of the material into said first chamber;

air directing means mounted within said first chamber for directing treated air over the material being transported through said first chamber; and discharge means for discharging the substrate from said first oven.

16. The apparatus of claim 15, wherein the transporting means comprises a continuous conveyor including a plurality of pairs of alternating substantially vertical upward and downward runs.

17. The apparatus of claim 15, wherein said first oven comprises a second chamber, said air supply means comprises an air charge inlet formed in said outer wall, a fan means for drawing exterior air into said second chamber through said air charge inlet, a charge damper mounted in said air charge inlet to control the flow of exterior air into said second chamber, air heating means for heating the exterior air drawn into said second chamber to said effective temperature, and air humidifying means for increasing the humidity of the exterior air to said effective humidity, said fan means directing the treated air into said first chamber.

18. The apparatus of claim 17, wherein said air heating means comprises a burner for heating a fluid, a heat exchange means in flow communication with said burner for circulating the heated fluid through a heat exchange passage having a heat exchange surface to heat said heat exchange surface, the air in said second chamber being drawn over the heated heat exchange surface by said fan means.

19. The apparatus of claim 16, wherein the air directing means comprises a plenum mounted between each pair of alternating substantially vertical upward and downward runs, each plenum having a front wall, a pair of opposed sidewalls and an interior plenum chamber, said front wall defines an air inlet slot through which treated air enters said plenum chamber, and said opposed sidewalls each define a plurality of air discharge slots for directing treated air within said plenum chamber over the material being transported by said continuous conveyor.

20. The apparatus of claim 19, wherein said air discharge slots are oriented at an acute angle relative to the horizontal, and the air discharge slots in the respective opposed sidewalls being approximately parallel relative to each other.

21. The apparatus of claim 16, wherein said continuous conveyor comprises a plurality of carriers for carrying the material, each carrier being adapted to automatically remove the substrate from said charge means and unload the substrate onto said discharge means.

22. An apparatus for the curing of pasted battery plates, comprising:

a hydroset oven including a hydroset chamber;

first charge means for automatically introducing pasted battery plates into said hydroset chamber;

first transport means mounted within said hydroset chamber for transporting the pasted battery plates therethrough along a first continuous path comprising at least one substantially vertical upward run and at least one substantially vertical downward run;

first air supply means for supplying into said hydroset chamber treated air of an effective temperature and humidity to affect hydrosetting of the pasted battery plates;

first air directing means mounted within said hydroset chamber for directing treated air over the pasted battery plates being transported through said hydroset chamber;

first discharge means for discharging the pasted battery plates from said hydroset oven;

a drying oven including a drying chamber;

second charge means for automatically introducing the pasted battery plates discharged from said hydroset oven into said drying chamber;

second transport means mounted within said drying chamber for transporting the pasted battery plates therethrough along a second continuous path comprising at least one substantially vertical upward run and at least one substantially vertical downward run;

second air supply means for supplying into said drying chamber heated air of an effective temperature and humidity to affect drying of the pasted battery plates;

second air directing means mounted within said drying chamber for directing heated air over the pasted battery plates being transported through said drying chamber; and second discharge means for discharging the pasted battery plates from said drying oven.

23. The apparatus of claim 22, wherein said first and second transport means are each comprised of a continuous conveyor including a plurality of pairs of alternating substantially vertical upward and downward runs.

24. The apparatus of claim 22, wherein said first air supply means comprises first air heating means for heating exterior air drawn into a treated air supply chamber, an air humidifying means for increasing the humidity of the exterior air, a first fan means for directing the heated and humidified air into said hydroset chamber, and said second air supply means comprises second air heating means for heating exterior air drawn into a heated air supply chamber, and a second fan means for directing the heated air into said drying chamber.

25. The apparatus of claim 24, wherein said hydroset oven comprises a first exhaust means for exhausting treated air discharged from said hydroset chamber exterior to said hydroset oven, and a first air charging means for allowing a controlled flow of exterior air into said treated air supply chamber, said drying oven comprises a second exhaust means for exhausting a heated air discharged from said drying chamber exterior to said drying oven, and a second air charging means for allowing a controlled flow of exterior air into a heated air supply chamber.

26. The apparatus of claim 24, wherein said first and second air heating means each comprise a burner for heating a fluid, a heat exchange means in flow communication with said burner for circulating the heated fluid through a heat exchange passage having a heat exchange surface to heat said heat exchange surface, air being drawn over said heat exchange surface by said fan means and heated.

27. The apparatus of claim 23, wherein said first and second air directing means each comprise a plenum mounted between each pair of alternating substantially vertical upward and downward runs, each plenum having a front wall, a pair of opposed sidewalls and an interior plenum chamber, said front wall defines an air inlet slot through which treated air and heated air, respectively, enters said plenum chamber, and said opposed sidewalls each define a plurality of air discharge slots for directing treated air and heated air, respectively, within said plenum chamber over the pasted battery plates, in said hydroset chamber and said drying chamber, respectively.

28. The apparatus of claim 27, wherein said air discharge slots are oriented at an acute angle relative to the horizontal, and the air discharge slots in the respective opposed sidewalls being approximately parallel relative to each other.

29. The apparatus of claim 23, wherein each of said first and second transport means comprises a continuous conveyor including a plurality of carriers for carrying the pasted battery plates, each carrier of said first transport means being adapted to automatically remove the pasted battery plates from said first charge means and unload the pasted battery plates onto said first discharge means, and each carrier of said second transport means being adapted to automatically remove the pasted battery plates from said second charge means and unload the pasted battery plates onto said second discharge means.

* * * * *